United States Patent [19]

Hafner

[11] 4,336,446

[45] Jun. 22, 1982

[54] APPARATUS FOR THE MANUAL PRODUCTION OF DIGITAL PULSES

[75] Inventor: Dieter Hafner, Nuremberg, Fed. Rep. of Germany

[73] Assignee: Diehl GmbH & Co., Nuremberg, Fed. Rep. of Germany

[21] Appl. No.: 94,389

[22] Filed: Nov. 15, 1979

[30] Foreign Application Priority Data

Dec. 12, 1978 [DE] Fed. Rep. of Germany ..... 2853505

[51] Int. Cl.[3] ..... G06M 3/14

[52] U.S. Cl. ..... 235/92 DE; 235/92 EV

[58] Field of Search ..... 235/92 EV, 92 DE, 92 MP, 235/92 PE; 368/188, 187; 328/59

[56] References Cited

U.S. PATENT DOCUMENTS

| | | | |
|---|---|---|---|
| 2,906,832 | 9/1959 | Foster et al. | 200/18 |
| 3,647,994 | 3/1972 | Vozenilek | 200/4 |
| 3,651,287 | 3/1972 | Rubenstein | 200/11 R |
| 3,835,384 | 9/1974 | Liff | 235/92 EV |
| 4,091,612 | 5/1978 | Meisner et al. | 368/155 |
| 4,192,993 | 3/1980 | Wechsler | 235/92 DE |

FOREIGN PATENT DOCUMENTS

| | | |
|---|---|---|
| 275644 | 10/1969 | Austria . |
| 414266 | 5/1925 | Fed. Rep. of Germany . |

*Primary Examiner*—Joseph M. Thesz

*Attorney, Agent, or Firm*—Burns, Doane, Swecker & Mathis

[57] ABSTRACT

A device for the manual production of digital pulses in a forward-backward counter comprises pulse-producing elements arranged helically on a rotating axle. The pulse-receiving elements are arranged linearly along the rotating axle in one or several rows. The distance between the pulse absorbing elements is unequal to the pitch of the helical line, whereby the pulse-receiving elements are acted upon individually in succession or in several groups in succession. The interaction between pulse-producing and pulse-receiving elements can be based on electronic, electromechanical or electromagnetic phenomena. The dimensions of the device are miniaturizable to the extent that the entire device can be housed together with the storage or microprocessor subordinate to it in an integrated electronic module of practicable size.

9 Claims, 6 Drawing Figures

APPARATUS FOR THE MANUAL PRODUCTION OF DIGITAL PULSES

BACKGROUND AND OBJECTS OF THE INVENTION

The invention concerns a device for the manual production of digital pulses for input into a storage constructed as an electronic forward-backward counter.

In such devices, an actuating element is connected mechanically with at least one pulse-producing element, a number of pulse-receiving elements and an evaluating logic whereby, when rotating the actuating element, individual pulses or pulse trains can be generated with the pulse-receiving elements and which, depending on the direction of rotation of the actuating element, can be counted into the forward counting input or the backward counting input of the storage.

Such devices are already well known. For example, from German DE-PS 25 40 486 which corresponds to U.S. Pat. No. 4,091,612 of the present applicant, an indicator-correcting device can be derived which features a pulse frequency for correction of the display. Characteristic for this pulse generator is a pulse wheel which can be driven manually or mechanically with a number of pulseproducing elements arranged on it and further a sensing element interacting with the pulse wheel and a pulse converter element interacting with the latter for production of electrical pulses. The pulse wheel can be turned in contact with the sensing element by means of an actuating element which is connected mechanically with the pulse wheel whereby individual pulses or pulse trains can be produced and whose frequency is a function of the rotating speed of the actuating element.

These individual pulses or pulse trains, depending on the direction of rotation of the actuating element can be counted either into the forward counter input or the backward counter input of a storage constructed as a forwardbackward counter and can, for example, be used for correction or for adjustment, as the case may be, of a digital display. The production of the electrical pulses can proceed electrooptically, electromagnetically or electromechanically according to DE-PS 25 40 486 which is incorporated herein by reference.

Basically, the pulse-producing elements are arranged on a pulse wheel on a circular path perpendicular to the rotating axis. It thereby must result that the pulse generator constructed in this manner in the plane of the pulse wheel occupies a relatively large space because, advantageously, a number of pulse-producing elements are arranged on the pulse wheel and interact with at least one, preferentially a number of, pulse-receiving elements which have to be arranged on the periphery of the pulse wheel.

Pulse generators of this type are difficult to accommodate in essentially flat housings, chiefly wristwatch housings or integrated electronic modules, since the rotating axis interacting with the pulse wheel is arranged in the plane of the flat watch housing and thus no space is available perpendicular to the rotating axis for the pulse wheel The object of the present invention is to provide a device for the manual production of digital pulses which is constructed extremely compact with respect to a space axis perpendicular to a rotating axis which interacts mechanically with an actuating element and at least one pulse-producing element. By this device, it should be possible to produce a number of pulses with one rotation of the rotating axis and, further, it should be possible to manufacture the device as inexpensively as possible from a few parts and in an especially simple way.

SUMMARY OF THE INVENTION

The object is solved according to the invention in that the pulse-producing elements are arranged in one or several helical lines around a rotating axis which is connected with the actuating element of the device. The pulse-receiving elements, on the other hand, are arranged linearly along the rotating axis in one or several rows and can be acted upon individually or in groups by the one or more helically arranged pulse-producing elements.

Further advantageous constructions are possible whereby, for example, the distance of the pulse-receiving elements arranged linearly along the rotating axis is not equal to the pitch of the helical line on which the pulse-producing elements are arranged around the rotating axis. The helical line can be interrupted at one or several points, the pulse-receiving elements should interact electrically in at least two groups and, by means of the helical arrangement of the pulse-producing elements, the pulse-receiving elements should be acted upon within their group according to their linear sequence. The construction of the device can be so extensively miniaturizable that all parts of the device are housed in a semi-integrated way in a storage module or microprocessor module of the practicable size.

THE DRAWING

The invention is explained more in detail on the basis of a number of preferred embodiments thereof depicted in several figures of the drawing, wherein.

DETAILED DESCRIPTION OF PREFERRED EMBODIMENTS OF THE INVENTION

Figure 1:
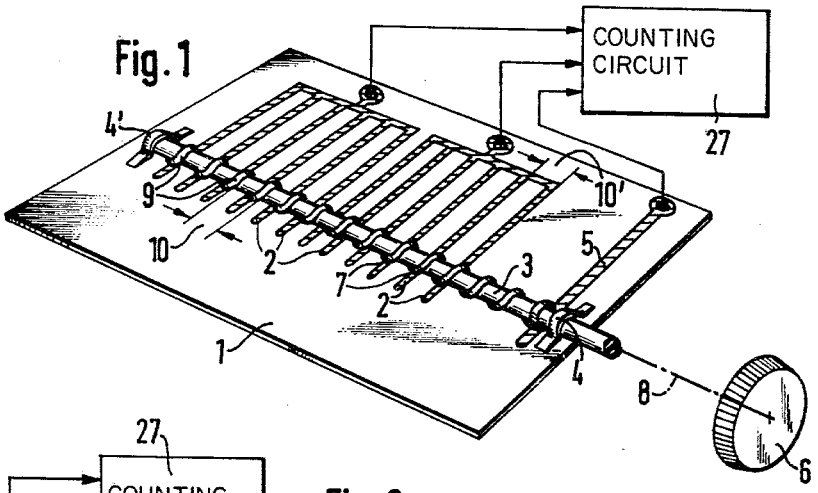
FIG. 1 depicts a first form of a device according to the invention whereby a pulse-producing element is constructed as a metal screw and the pulse-receiving elements are constructed as contact strips.

In FIG. 1, there is disclosed a device according to the invention for the manual production of digital impulses for input into an electronic forward-backward counter. The device comprises one insulator plate 1 on which a number of contact strips 2 are mounted by means of an etching process. A screw 3, made of electrically conductive material, for example a metal screw is mounted on the plate and, arranged perpendicularly to the contact strips 2. The screw 3 includes a helical flight 9 which touches one or several of the contact strips 2 whereby an electrically conductive connection is established. The screw 3 is held at both its two ends in two bearings 4, 4'. Adjacent the bearing 4 is disposed a contact element 5 which is continuously electrically connected with the helical flight independently of the rotational position of screw 3.

The contact elements 2, 5 are electrically connected with an electronic circuit 27 which essentially comprises a direction-of-rotation recognition circuit for the shaft, a pulse shaper's logic and a forward-backward counter.

An actuating knob 6 is connected with screw 3. By rotating the knob 6 the points 7 of the screw 3 which contact either the insulating plate 1 or the contacts 2, move in one or the other direction along the rotating axis 8 of the screw. Accordingly, the contacts 2 arranged on the insulating plate 1 are alternately touched by the helical flight 9 of the metal screw 3. Depending upon the separating distance 10' between the contacts 2 and the pitch 10 of the screw 3, the screw 3 and the contacts 2 are opened and closed individually in sequence or in groups. By an appropriate interconnection, for example a parallel circuit of all contacts 2, there can be caused by rotation of actuating element 6 the production of individual pulses or pulse trains which, depending on the direction of rotation of actuating element 6, can be counted into the forward-counting input or the backward-counting input of a forward-backward counter.

Figure 2:
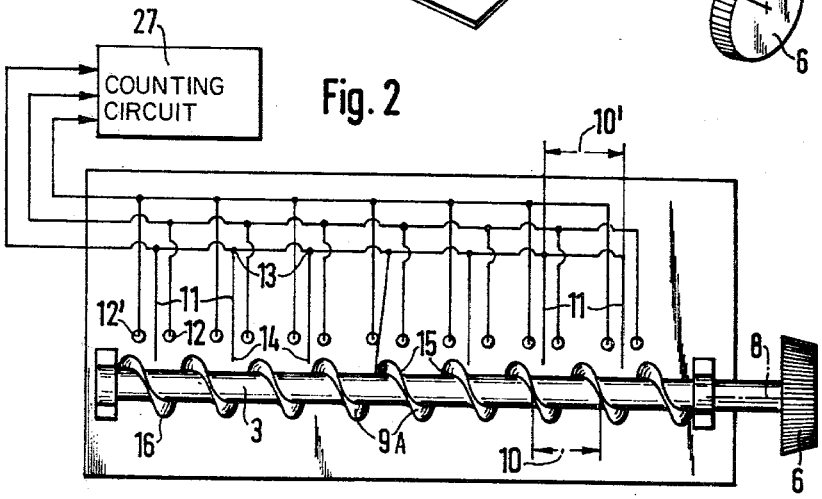
FIG. 2 depicts a second embodiment of the invention in which the pulse-producing element is constructed as a metal screw and the pulse-receiving elements as spring contacts.

FIG. 2 shows an alternate device according to the invention in which the helical-arranged pulse-producing elements, mechanically contact the pulse-receiving elements, each in the form of a spring element 11 arranged between two electrical contacts 12, 12'. Each one of the spring elements 11 is supported permanently at its one end 13, its tip 14 projects into the path of the helical flight 9 of 9A screw 3 which forms the pulse producer. The screw 3 is mechanically connected with an actuating element 6.

If this actuating element 6 is rotated, the tips 14 of spring element 11 are contacted by the sides 15 of the flite 9A of screw 3 and are shifted axially along the rotating axis 8 in one or the other direction, depending on the direction of rotation, and touch one of a pair of contacts 12, 12' associated therewith. If screw 3 is further twisted by means of actuating element 6, it follows that the respective contact sections remain closed so long until the tips 14 of the spring elements 11 spring over the outside edge 16 of the flite 9A.

Again, the distance 10' between the spring elements 11 and pitch 10 of the screw flite 9A of screw 3, acting as a pulse-producing element, can be selected such that, with a turn of screw 3 around its axis 8, the contact sections formed by contact elements 11, 12, 12' can be produced and closed individually or in groups.

Figure 3:
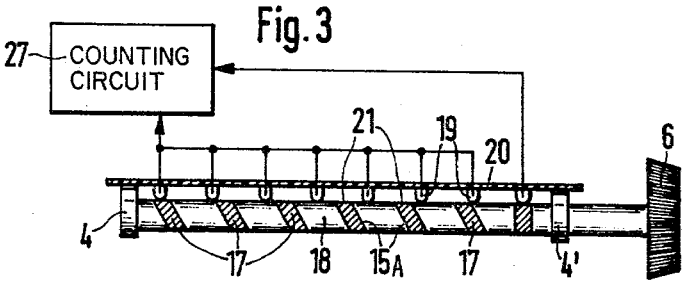
FIG. 3 depicts a third embodiment of the invention in which the pulse-producing element is a spiral conductor which is arranged on one shaft made of insulating material and interacts with pulse-receiving spring contacts.

In another form of the pulse generator in accordance with the invention shown in FIG. 3, a conductive layer 17 acting as pulse-producing element is arranged helically around a rotatable shaft 18 which is made of insulating material and which is connected mechanically with an actuating element 6. By rotating the actuating element 6, the flight 15A of this helically-arranged conductive layer 17 contacts with one or several rows of contact elements 19 (only one row or group of contact elements is illustrated in FIG. 3 for clarity) which, for example, can be positioned on a printed circuit board 20. Depending on the direction of rotation of the actuating element 6, the surface 21 of the helically arranged conductive layer 17 migrates in one or the other direction along shaft 18 and closes one or several contact sections sequentially or in a manner already described.

Figure 4:
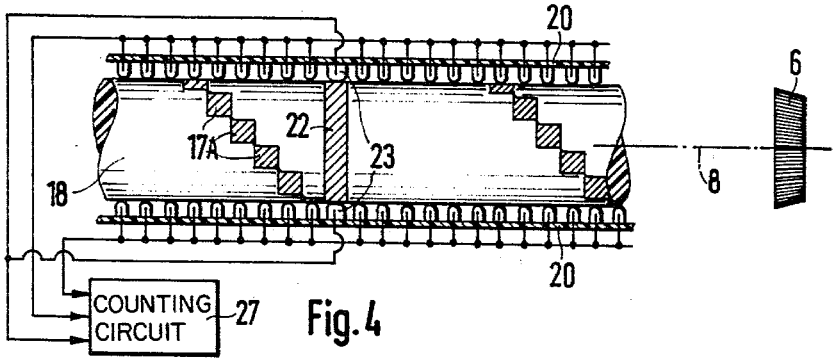
FIG. 4 depicts a modification of the third embodiment wherein a stepped graduation of the helically arranged pulse-producing element is provided.

In another form of construction shown in FIG. 4, the conductive layer 17A arranged helically around a shaft 18 is graduated in steps. This thereby guarantees a more exact contact between the pulse-producing elements and the pulse-receiving elements 19 which are also in this form of construction arranged along shaft 18 in one or several rows. As can be seen from this FIG. 4, a number of pulse-receiving contact elements 18 can be arranged in one or several rows along the pulse-producing conductive layer 17 which is helically arranged. In the center of the wave section shown in FIG. 4, the layer 17 of a conductive material is constructed around shaft 18 as a ring 22 and maintains continuous connection with one or several contacts 23 as well as with the helically-arranged pulse-producing layer 17. By rotating the shaft 18, the contact sections between the one or more contacts in connection with the conducting ring 22 and the contact elements 19 interacting with the helical layer are accordingly opened and closed.

Figure 5:
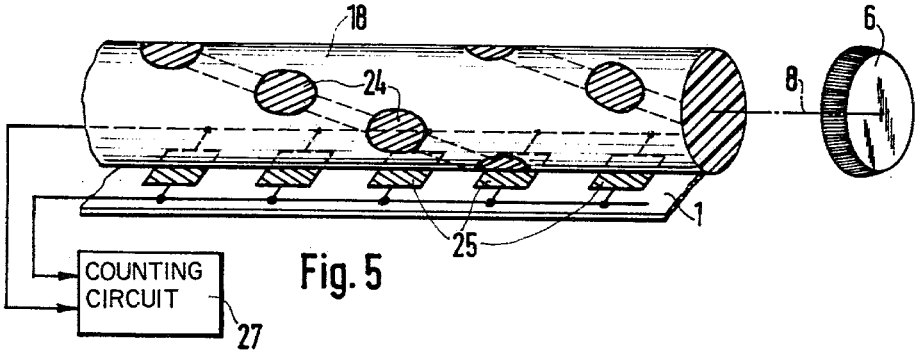
FIG. 5 depicts another embodiment of the invention.

The modified form of pulse generator showed in FIG. 5 likewise features a rotatable shaft 18 which is provided with helically-arranged pulse-producing elements. These pulse-producing elements interact with one or several rows of pulse-receiving elements. As in FIG. 3, only one row or group of pulse receiving elements is illustrated in FIG. 5 for clarity. The pulse-producing elements comprise magnetic areas 24 arranged helically on or in the shaft 18 and whose direction of magnetization can be oriented in an equilibrium case perpendicular to the rotating axis of shaft 18. The magnetic leakage field $\overline{H}_s$ which, owing to the pole induction of areas 24, leaves from shaft 18, can interact with one or several rows of pulse-receiving elements which should be constructed more advantageously in this case as standard magneto-resistance elements 25.

Figure 6:
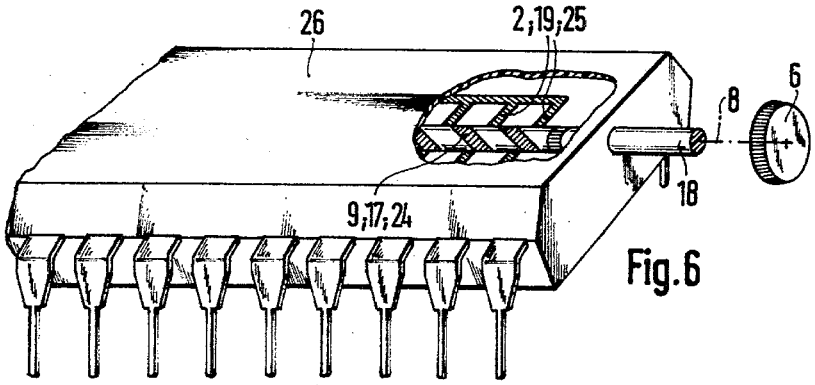
FIG. 6 depicts the arrangement of the invention in an integrated circuit.

By rotating the actuating element 6, which is mechanically connected with the rotating shaft 18, the flux change $\Delta\sigma$, which is produced on the magneto-resistance elements 25 by conducting by the magnetic leakage fields $\overline{H}_s$, produces resistance changes $\Delta\sigma$ which can easily be reshaped to pulses in a well-known way by electronic circuits (not shown) connected to the magneto-resistance elements 25 and which are suitable for counting into the forward-backward counter. A device provided with such pulse-producing and pulse-receiving elements is to the highest degree miniaturizable and integratable. The state of technology allows the manufacture today of magnet-resistance elements 25 whose dimensions actually amount to a number of micrometers. Further materials are well known, for example, metal glazes whose magnetic and mechanical properties enable the construction of a very thin rotating shaft 18 with the magnetic properties which are indicated in FIG. 5. A pulse generator of such a type can be accomodated immediately together with a subordinate pulse-shaping circuit, a further circuit for the recognition of direction of rotation of the shaft and a forward-backward counter in an integrated electronic module 26 as is shown in FIG. 6. Integrated digital storages of such a type in which the manually operable input device is co-integrated can be applied, for example, as "digital trim potentiometers" in digital circuits or as a circuit element in electronic small clocks. In the pulse generator based on the principle of magneto-resistance change the pulse-producing elements, arranged helically on a rotating shaft, work without contact and are thereby extensively wear-resistant. A device of this type is characterized by very small dimensions perpendicular to the rotating axis 8 of shaft 18 at least in connection with one space axis. On the basis of this, it appears to be especially suited for incorporation, together with electronic switches and forward-backward counters, in one integrated module 26 or in a very flat wristwatch housing. The pulse-receiving elements can be applied by masking technology in integrated form to the carrier of the electronic switch and storage elements in an extremely functional and economical way. The rotating shaft 11 on which the pulse-producing elements are helically arranged could, for example, be designed from a metal glaze, such as Fe-P-B, since such compounds possesss both the necessarily high magnetic moments as well as the mechanical prerequisites for such a device.

Of course, the shaft 18 can also be of any other non-magnetic material on which a magnetic layer is helically applied which, owing to thermal and magnetic pretreatment, satisfies the magnetic requirements which are needed for pulse production according to the invention.

Although the invention has been described in connection with a preferred embodiment thereof, it will be appreciated by those skilled in the art that additions, substitutions, modifications, and deletions not specifically described may be made without departing from the spirit and scope of the invention as defined in the appended claims.

What is claimed is:

1. In a device for the manual production of digital pulse for input into an electronic forward-backward counter, the device comprising a rotatable actuating element connected mechanically with at least one pulse-producing means, several pulse-receiving elements, and an evaluating logic whereby individual pulses or pulse trains can be produced upon rotation of the actuating element by mutual interaction of the pulse-producing means with the pulse-receiving elements and which, depending on the direction of rotation of the actuating element, are to be counted in the forward counting input or the backward counting input of the forward-backward counter, the improvement wherein the pulse-producing means is arranged helically on a rotatable axle operably connected with the actuating element, the pulse-receiving elements are arranged linearly along the rotating axle in at least one row to be actuated by the helically-arranged pulse-producing means, the distance between the pulse-receiving elements is different from the pitch of the helical line defined by the pulse-producing means, and the pulse-receiving elements interact electrically in at least two groups such that upon rotation of the actuating element, at least two pulses are produced which are offset in time and overlapping.

2. Apparatus according to claim 1, wherein a helical line defined by the pulse-producing means is interrupted at at least one point.

3. Apparatus according to claim 1, wherein the pulse-receivng elements are arranged to be actuated sequentially by the helically-arranged pulse-producing means upon rotation of the actuating element.

4. Apparatus according to claim 1, wherein the pulse-receiving elements are fixed along the rotating axle.

5. Apparatus according to claim 1, wherein the pulse-receiving elements, the pulse-producing means, the evaluating logic and the forward-backward counter are housed in a single integrated electronic module.

6. Apparatus according to claim 1, wherein said pulse-producing means comprises a helical flight of an electrically conductive screw, the pulse-receiving elements comprising contact strips which are attached on an insulating plate, the screw being rotatably supported on the insulating plate such that the screw flite touches the contact strips when the actuating element is rotated.

7. Apparatus according to claim 1, wherein said pulse-producing means comprises an electrically conductive layer arranged helically around said axle which is made of insulating material, the windings of the layer interacting electrically with said pulse-receiving elements which comprise at least one row of contact elements arranged on a printed circuit board.

8. Apparatus according to claim 7, wherein the edges of the helically-arranged conductive layer are step-graduated, the step width corresponding to the distance between the contact elements.

9. Apparatus according to claim 1, wherein said pulse-producing means comprise magnetic areas arranged helically on or in said axle, said areas comprising magneto-resistance elements and the leakage field of the magnetic areas interacting with pulse-receiving elements which comprise spaced magneto-resistance elements.

* * * * *